US005362207A

United States Patent [19]

Martin et al.

[11] Patent Number: 5,362,207

[45] Date of Patent: Nov. 8, 1994

[54] PORTABLE DIESEL-DRIVEN CENTRIFUGAL AIR COMPRESSOR

[75] Inventors: Daniel T. Martin, Clemmons; William H. Harden, III, Yadkinville; Dale R. Herbstritt; Dilip K. Mistry, both of Clemmons, all of N.C.

[73] Assignee: Ingersoll-Rand Company, Woodcliff Lake, N.J.

[21] Appl. No.: 74,251

[22] Filed: Jun. 9, 1993

[51] Int. Cl.[5] ..... F04B 23/00

[52] U.S. Cl. ..... 417/243; 417/299; 417/308; 415/179; 165/140

[58] Field of Search ..... 417/243, 364, 290, 299, 417/302, 303, 307, 308; 165/140; 415/179; 137/492

[56] References Cited

U.S. PATENT DOCUMENTS

| | | | |
|---|---|---|---|
| 2,362,724 | 11/1944 | Shea | 417/308 |
| 2,469,224 | 5/1949 | Caine | 417/302 |
| 2,482,626 | 9/1949 | Lamberton | 417/243 |
| 3,007,492 | 11/1961 | Grimmer | 137/492 |
| 3,153,508 | 10/1964 | Sawyer | 417/243 |
| 3,644,054 | 2/1972 | Pilarczyk | 417/243 |
| 3,871,397 | 3/1975 | Larsen | 417/299 |
| 4,406,589 | 9/1983 | Tsuchida et al. | 417/302 |
| 4,729,721 | 3/1988 | Hansen et al. | 417/308 |

FOREIGN PATENT DOCUMENTS

| | | | |
|---|---|---|---|
| 1128406 | 10/1954 | France | 417/243 |

OTHER PUBLICATIONS

Dan Gerhardt, F. William Capp, Dilip K. Mistry, & Richard Worthen "High Efficiency Diesel Powered Centrifugal Compressor and Electrical Generator For Aircraft Ground Support"–Oct. 5–8, 1987.

Don Gerhardt & Thomas Sills, "Microprocessor Control For Diesel Powered Equipment".

Don Gerhardt & Thomas Sills "Microprocessor Control For Diesel Powered Equipment"–Apr. 7–9, 1987.

Don Gerhardt & Thomas Sills "Microprocessor Based Diagnostics For Diesel Powered Equipment"–Feb. 23–27, 1987.

*Primary Examiner*—Richard A. Bertsch
*Assistant Examiner*—M. Kocharov
*Attorney, Agent, or Firm*—Victor M. Genco, Jr.

[57] ABSTRACT

A portable compressed air system includes a housing, and a diesel engine having a predetermined torsional inertia, a predetermined cranking speed, and a predetermined idle speed. A centrifugal compressor is flexibly coupled in motive force receiving relation to the diesel engine. The flexible coupling has a predetermined spring rate which places the torsional interia of the compressor above a highest predetermined cranking speed and below the predetermined idle speed of the diesel engine. A microprocessor-based electronic controller controls compressor operation. A receiver stores compressed air. A cooling means cools the portable compressed air system. The cooling means has a fan, an intercooler, an oil cooler, an engine radiator, and an aftercooler. The intercooler, the oil cooler, the radiator, and the aftercooler are arranged in two banks, and each bank is defined by two cooling cores juxtaposed one to each other.

9 Claims, 13 Drawing Sheets

TOP LEVEL MENU STRUCTURE

PORTABLE DIESEL-DRIVEN CENTRIFUGAL AIR COMPRESSOR

BACKGROUND OF THE INVENTION

This invention generally relates to compressors, and more particularly to a portable, diesel-driven, microprocessor-based, centrifugal compressor.

Many modern industries, such as the pharmaceutical industry, the food processing industry, and the textile industry require "oil-free" compressed air. Two types of compressors which are capable of supplying oil-free compressed air are the dry-screw type compressor and the centrifugal compressor. The dry-screw type compressor and the centrifugal compressor each have respective advantages and disadvantages, however, at compressor outputs above 1000 cubic feet per minute (CFM), centrifugal compressors offer distinct advantages, such as better overall performance, a longer operating life, and better reliability. Despite the advantages of the centrifugal compressor, this type compressor has not been widely used in truly portable applications because of the complex design challenges associated with packaging a portable centrifugal compressor. To date, the most common type of portable, oil-free compressor has been the dry-screw compressor.

Water cooling systems are used with stationary centrifugal compressors because these cooling systems are extremely efficient, and usually lower the temperature of compressed air entering a second stage to temperatures near or below ambient temperature. Additionally, water cooling systems are able to cool final stage compressed air to temperatures well below the temperatures required by the industrial applications using the oil-free air. It is not uncommon for water cooling systems to cool final stage air to temperatures below 110° to 120° F. However, for a compressor to be truly portable, it must be air cooled, as opposed to liquid or water cooled, because water cooling typically is not available at remote locations. Also, in a portable compressor application, the machine must be able to operate in a wide range of ambient temperatures and altitudes. These portable compressors must be able to operate in temperatures ranging from minus 20° F. to temperatures of approximately 120° F.

To date, portable dry-screw compressors which have employed an air cooling system have only been able to cool final stage compressed air to temperatures of approximately 120° F. above ambient temperature. However, such final stage compressed air temperatures typically exceed the temperature requirements of many of the modern industrial applications which require oil-free air. Therefore, in use, these air cooled dry-screw compressors must employ an additional stand alone aftercooler to supplement the main air cooling system of the dry-screw compressor. This of course is an additional expense for the user.

Centrifugal compressors rotate at extremely high speeds. For example, rotational speeds for a first stage impeller can be as high as 55,000 revolutions per minute (RPM), and rotational speeds for a second stage impeller can be as high as 66,000 RPM. Such rotational speeds, in combination with a nominal engine speed of approximately 1800 RPM, produce a gear ratio from engine speed to the first stage impeller speed of approximately 31:1, and a gear ratio from engine speed to the second stage impeller speed of approximately 38:1. These high gear ratios create high inertial forces within the compressor package. Additionally, engine torsional excitations which are caused by normal operation of a diesel engine, which is typically the prime mover of choice for a portable compressor, are an extremely disruptive force for the compressor gearing system and for compressor operation. Accordingly, a major deterrent which has heretofore thwarted commercial exploitation of a portable, diesel driven, centrifugal compressor has been an apparent industry wide inability to successfully couple a centrifugal compressor (air-end), having a high torsional inertia, to a diesel engine, which produces extreme engine torsional excitations.

Centrifugal compressor systems which include pneumatically controlled valves and components require high quality instrument air to be delivered to these pneumatic controlled components. Centrifugal compressors also require a source of sealing air. When a stationary centrifugal compressor package is installed within a manufacturing facility, typically, the instrument air and the seal air are provided from a source external to the centrifugal compressor package, such as by the manufacturing facility itself. However, in truly portable compressor applications at remote locations, facility or plant supplied instrument air typically is not available for use by the portable compressor to meet its instrument and seal air needs. Additionally, if such plant or facility supplied instrument air is available, often this externally supplied instrument air contains particulates, debris, and other foreign matter which clogs or otherwise damages the very sensitive pneumatically controlled components.

It is often necessary to unload or de-pressurize a compressor, such as for maintenance or during compressor shutdown. One method of unloading or depressurizing a compressor is by way of a blowoff valve. A fail-safe type blowoff valve is a spring loaded open type blowoff valve. Such a spring loaded open, blowoff valve is typically pneumatically controlled, and this valve must be pneumatically actuated to a closed position upon initial compressor start-up to pressurize or load the compressed air system. Presently, in compressed air systems which employ spring loaded open, pneumatically controlled, blowoff valves, upon initial compressor start-up, these valves are actuated to a closed position by externally supplied instrument air, such as by plant or facility supplied instrument air. Accordingly, despite the laudable fail-safe benefits of employing a spring loaded open, pneumatically actuated blowoff valve in a compressed air system, these valves have not been employed in compressors to be used in remote, portable applications because there has not been an available method to pneumatically close these valves upon initial compressor start-up.

A portable compressor must have a lubricating oil system which is capable of operating in environments ranging from arctic conditions to desert conditions. While present portable compressor lubrication systems may have operated with some degree of success, these lubrication systems are replete with a multiplicity of deficiencies and shortcomings which have detracted from their usefulness.

The foregoing illustrates limitations known to exist in present portable compressors. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a portable compressor including a housing, and a diesel engine having a predetermined torsional inertia, a predetermined cranking speed, and a predetermined idle speed. A centrifugal compressor is flexibly coupled in motive force receiving relation to the diesel engine. The flexible coupling has a predetermined spring rate which places the critical speed of the system above a highest predetermined cranking speed and below the predetermined idle speed of the diesel engine. A microprocessor-based electronic controller controls compressor operation. A receiver stores compressed air. A cooling means cools the portable compressed air system. The cooling means has a fan, an intercooler, an oil cooler, an engine radiator, and an aftercooler. The intercooler, the oil cooler, the radiator, and the aftercooler are arranged in two banks, and each bank is defined by two cooling cores juxtaposed one to each other.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 2:
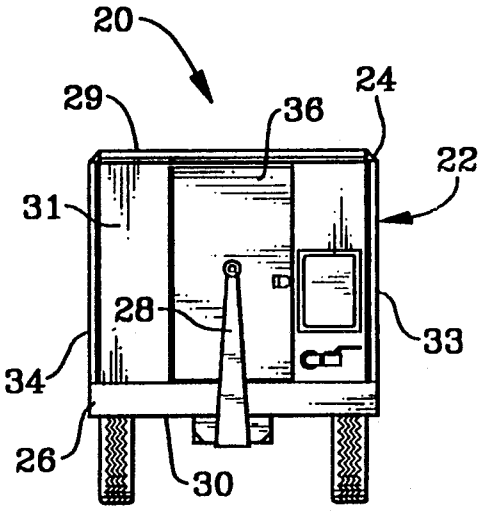
FIG. 2 is a front view of the portable, diesel-driven centrifugal compressor illustrated in FIG. 1.
Figure 1:
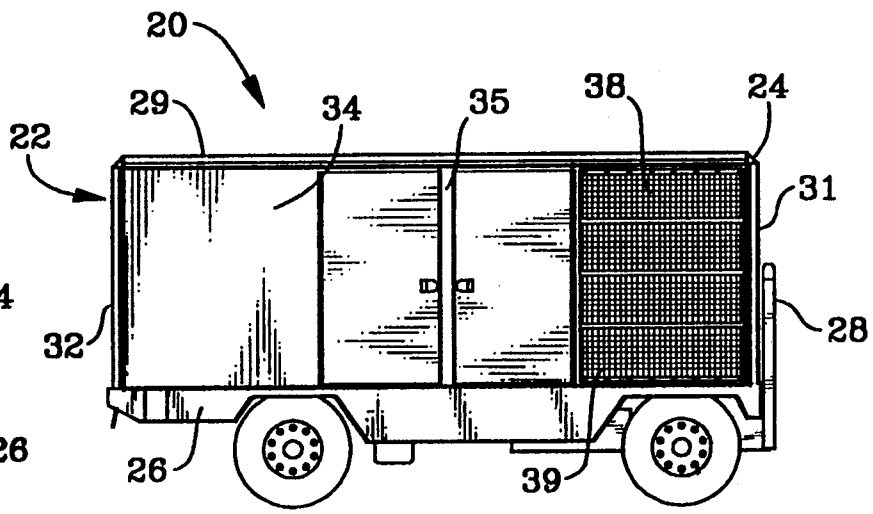
FIG. 1 is a side view of the portable, diesel-driven centrifugal compressor of the present invention.
Figure 3:
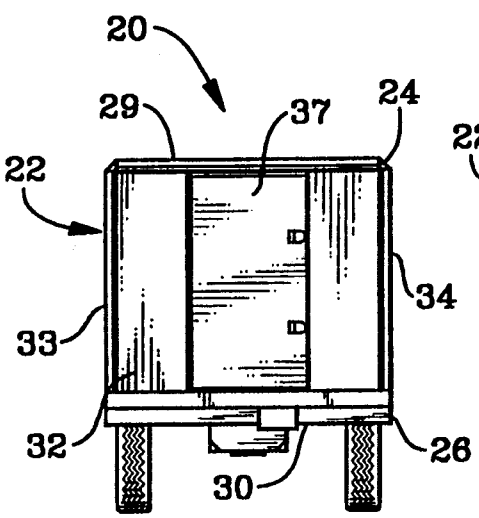
FIG. 3 is a rear view of the portable, diesel-driven centrifugal compressor illustrated in FIG. 1.

Referring now to FIGS. 1–3, the portable, diesel-driven centrifugal compressor according to the present invention is generally illustrated at 20. The apparatus 20 includes an upper compressor package portion 22 which is enclosed by a housing 24, and a full-chassis and running gear portion 26 which includes a tow bar assembly 28. The portable compressor 20 has a top portion 29, a bottom portion 30, a front portion 31, a rear portion 32, a left portion 33, and a right portion 34. The upper compressor package portion 22 includes five doors which permit access to the interior of the housing 24. A first door (not shown) is located on the left side 33 of the housing. Second and third doors 35 are located on the right side 34 of the housing. A fourth door 36 is located on the front portion 31 of the housing. A fifth door 37 is located on the rear portion 32 of the housing. A large ambient air intake 38 is located on each the left side and the right side of the housing. The ambient air intakes 38 are each covered by a protective grill 39 which prevents foreign debris from entering the interior of the compressor housing 24 during operation. The top portion of the housing includes an engine exhaust pipe outlet (not shown). The rear portion of the interior of the housing 24 includes an air exhaust area which will be described in further detail hereinafter.

Figure 4:
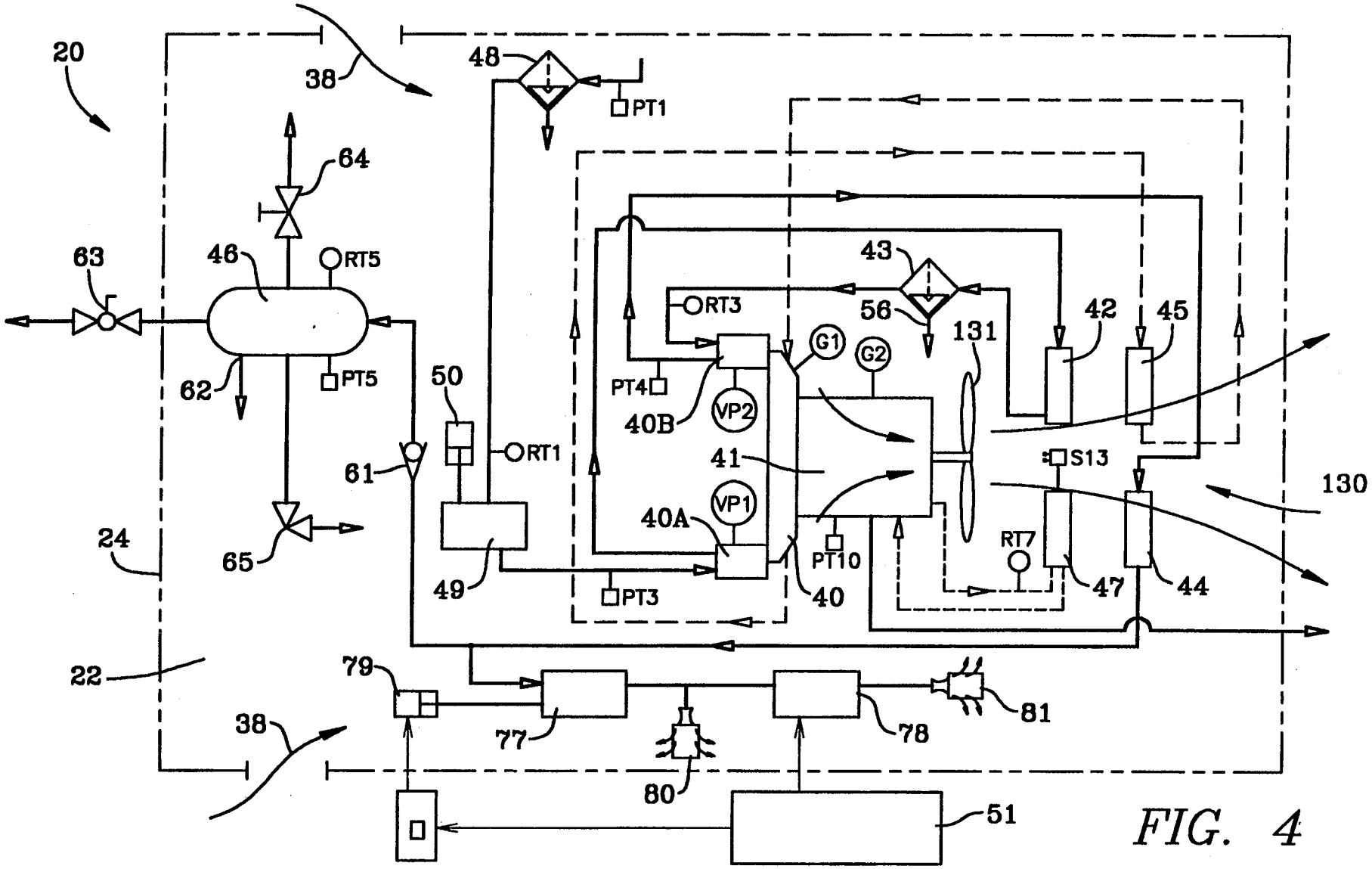
FIG. 4 is a functional schematic of a compressed air system of the portable, diesel-driven centrifugal compressor according to the present invention.

FIG. 4 is a functional schematic of the centrifugal compressed air system or compressor package of the portable, diesel-driven centrifugal compressor 20 of the present invention. FIG. 4 illustrates a compressed air system having the following major system components: a two stage centrifugal compressor or airend 40, having a first stage 40A, a second stage 40B, and a casing (not shown); a prime mover 41, such as a diesel engine having a casing (not shown); an intercooler 42; a water separator 43; an aftercooler 44; an oil cooler 45; a receiver tank 46; and an engine radiator 47. These major system components will be described in further detail hereinafter. Although a two-stage centrifugal compressor or airend 40 is described herein, it is anticipated that the teachings of the present invention apply equally to compressed air systems having one stage or more than two stages, as well.

The two stage centrifugal compressor 40 is driven by the diesel engine 41. In this regard, the centrifugal compressor casing is mounted on the diesel engine casing, and when mounted thereon, drive gearing of both the diesel engine and the airend are separated by a torsional spring or flexible coupling 153, see FIG. 6. The coupled airend and diesel engine represent a two mass single spring system. The first mass is the diesel engine which rotates through a spring, i.e. the flexible coupling, to a second driven mass, i.e. the airend.

In torsionally active systems, selection of the appropriate spring rate or stiffness of the flexible spring determines where a phenomenon known as critical speed occurs. In order for a portable, diesel-driven centrifugal compressor to function both efficiently and effectively, the centrifugal compressor must be coupled to the diesel engine in a manner to achieve torsional vibration isolation. This is accomplished using a commercially available flywheel-mounted elastomeric flexible coupling having a spring rate which will place the critical speed of the diesel engine above the highest predetermined cranking speed range of the diesel engine and below the predetermined idle speed of the diesel engine. The flexible coupling 153 is commercially available from the Holset Engineering Co., LTD., Model LK. Also, and when using such a flexible coupling, after the diesel engine is cranked or started, acceleration of the diesel engine must be quick through the critical speed to idle speed.

The coupled airend 40 and the diesel engine 41 are mounted to the chassis 26 by way of a three point mounting system (not shown), each mounting point including a lateral vibration isolator (not shown). The first and second mounting points are located at a respective side of the airend, and the third mounting point is located at a forward portion of the diesel engine. As with isolating torsional vibrations, it is important to properly select the stiffness of the lateral isolators to place the lateral critical speed outside of the operating speed range. In this regard, a lateral isolator spring rate must be selected which will place the lateral critical speed above the highest predetermined cranking speed range of the diesel engine and below the predetermined idle speed of the diesel engine. The lateral isolators also reduce and isolate sound generated by the compressor.

Figure 10:
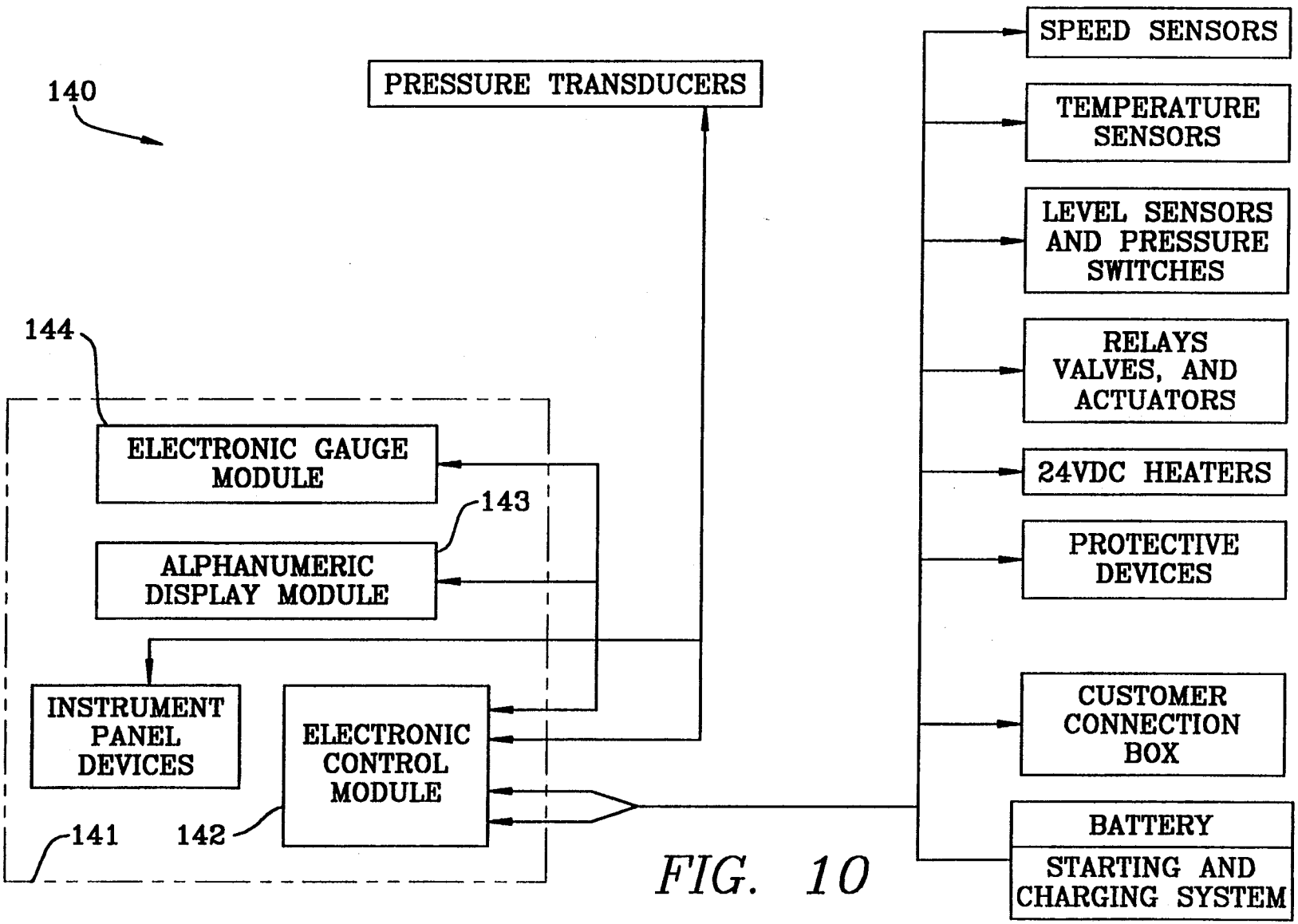
FIG. 10 is a block diagram of an electronic control system according to the present invention.

Referring to FIG. 4, airend intake air is drawn through the air intakes 38 and through two intake filters 48 which are disposed in a parallel fluid arrangement, and which are connected to a common plenum. The filtered intake air then flows from the common plenum through an inlet duct (not shown) to an inlet control valve 49. In the preferred embodiment, the inlet control valve 49 is a butterfly type valve, and is operated by a pneumatically controlled positioner/actuator 50. The inlet control valve 49 is used for pressure and capacity control and is dynamically controlled by a microprocessor based electronic controller 51 which is schematically illustrated by FIG. 10.

The inlet control valve 49 includes a mechanical stop (not shown) which prevents the valve from closing further than 15° from a "full-close" position. This minimum setting insures that adequate air flow passes through the airend at diesel engine idle speed to prevent centrifugal compressor surging. Also, this minimum setting permits a sufficient generation of seal air pressure while at idle speed, as will be described in further detail in the following paragraphs.

The compressor 20 includes instrumentation fluidly disposed in the intake air path upstream of the first stage of the airend. This instrumentation includes the following sensors: a pressure sensor PT1 which senses ambient barometric pressure; a temperature sensor RT1 which senses stage 1 inlet temperature; and a pressure sensor PT3 which senses stage 1 inlet vacuum.

Figure 8:
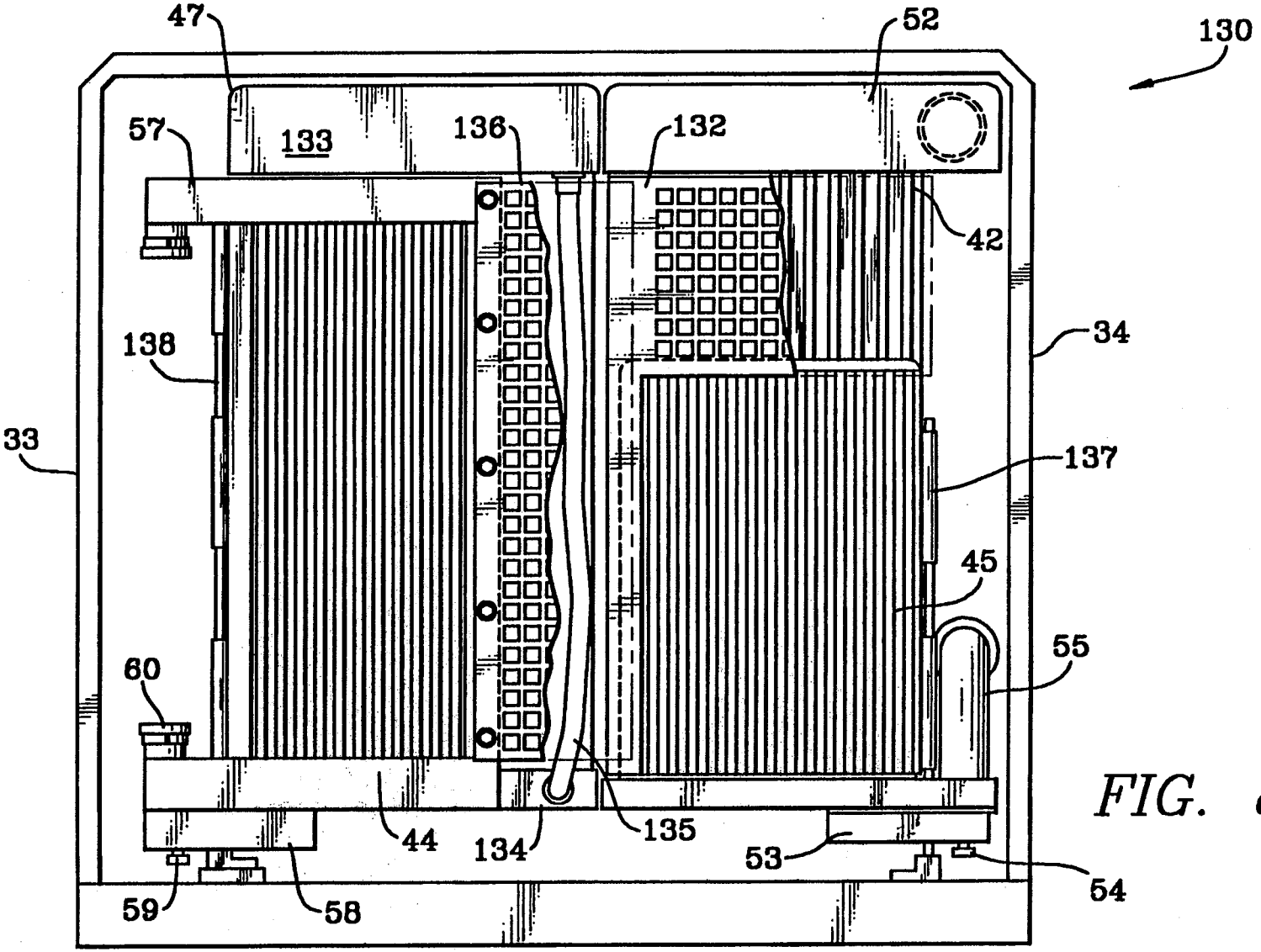
FIG. 8 is a partial, enlarged view of FIG. 3 illustrating a cooling system configuration according to the present invention.
Figure 9:
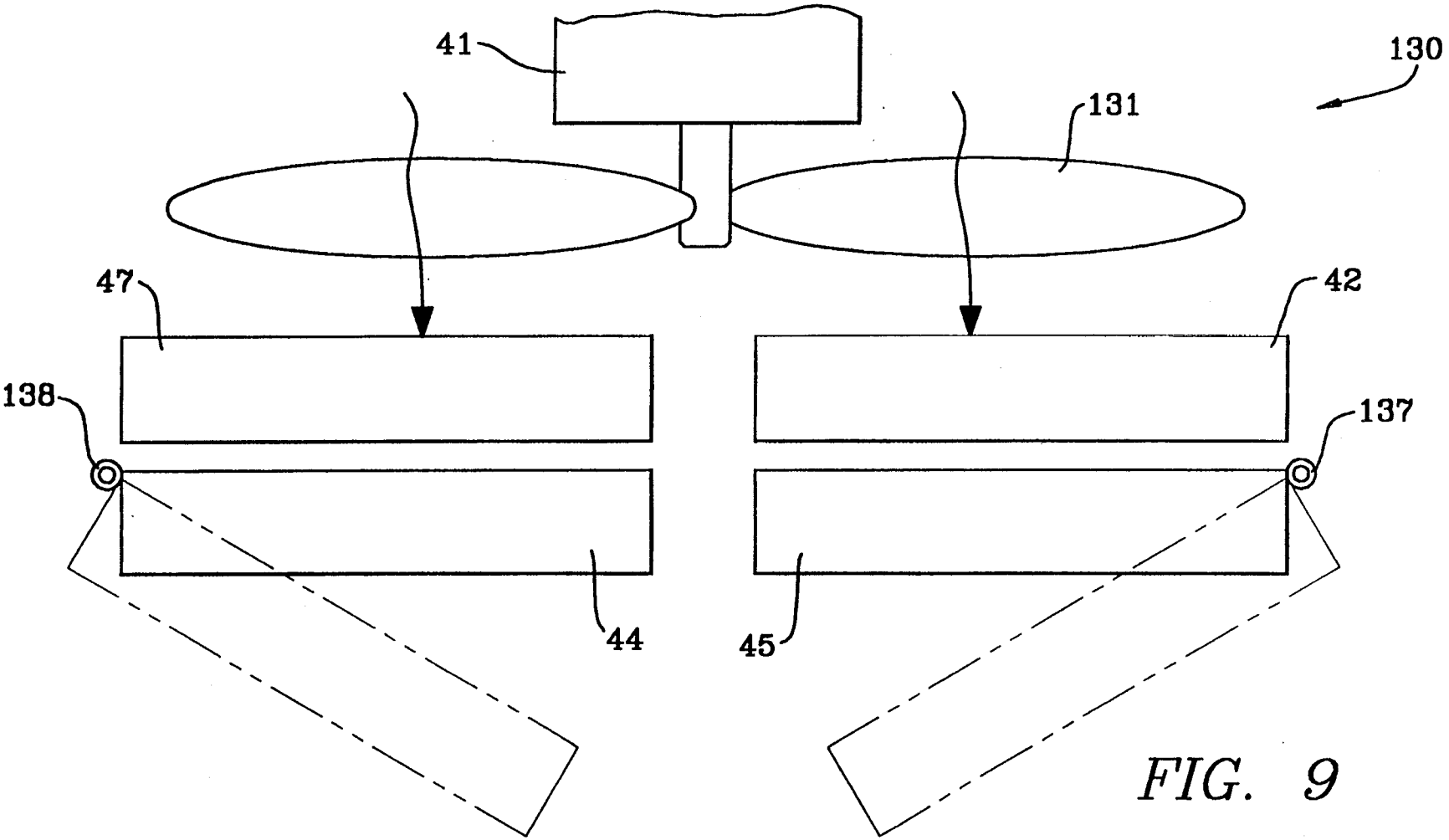
FIG. 9 is a partial, functional diagram of the cooling system illustrated in FIG. 8 detailing the location of individual cooler cores with respect to a cooling system fan.

Air entering the first stage 40A of the airend 40 is compressed to an intermediate predetermined pressure of approximately 35 PSIG. The air exits the first stage and flows through an interstage duct (not shown) to the intercooler 42 for cooling prior to entering stage two for final compression. Turning to FIGS. 4, 8 and 9, the intercooler 42 is one of four cooling cores on the compressor 20. As illustrated in FIG. 8, compressed air enters the intercooler at an intercooler top header portion 52, and flows in a downward direction within the intercooler wherein which it is cooled to within approximately 25° F. of the first stage inlet temperature. During this cooling process, water vapor is condensed, and a portion of the condensate is discharged into an intercooler bottom reservoir portion 53 and through a small drain orifice 54. Cooled and saturated interstage air leaves the intercooler 42 at an intercooler discharge 55 and flows through the water separator 43. Water removed from the compressed airstream by the water separator unit is discharged at the bottom of the water separator through a small drain orifice 56. Interstage air then flows from the water separator 43 to the airend 40 for second stage compression. Instrumentation present within the interstage air path includes a temperature sensor RT3 which measures second stage inlet temperature.

Interstage air is compressed by the second stage 40B to a pressure equal to 3–4 PSI above receiver tank pressure. The second stage compressed air exits the second stage 40B and flows through the afterstage discharge duct (not shown) to the aftercooler 44 for final cooling. As illustrated by FIG. 8, the compressed air enters the aftercooler 44 at an upper portion 57 and flows in a downward direction within the aftercooler wherein which it is cooled to approximately 55° F. above ambient temperature. During this final cooling process, water vapor is condensed, and a portion of the condensate is discharged into an aftercooler bottom reservoir portion 58, and through a small drain orifice 59. Cooled and saturated second stage compressed air then flows from the aftercooler, through a spring loaded wafer-style check valve 61, to the receiver tank 46. Additional condensate dropout or removal occurs at the receiver tank through a drain 62. The check valve 61 permits the receiver tank 46 to remain pressurized for a predetermined period of time after the airend unloads, thereby insuring a source of compressed air for the instrument air system which will be discussed in further detail hereinafter. Compressed air is discharged out of the compressed air system through a service valve 63. Also mounted in fluid communication with the receiver tank 46 is a manual blowdown valve 64 and a safety relief valve 65. Instrumentation which is present within the afterstage air path includes a pressure sensor PT4 which senses stage 2 outlet pressure, a pressure sensor PT5 which senses receiver tank pressure, and a temperature sensor RT5 which senses receiver tank temperature.

Figure 7:
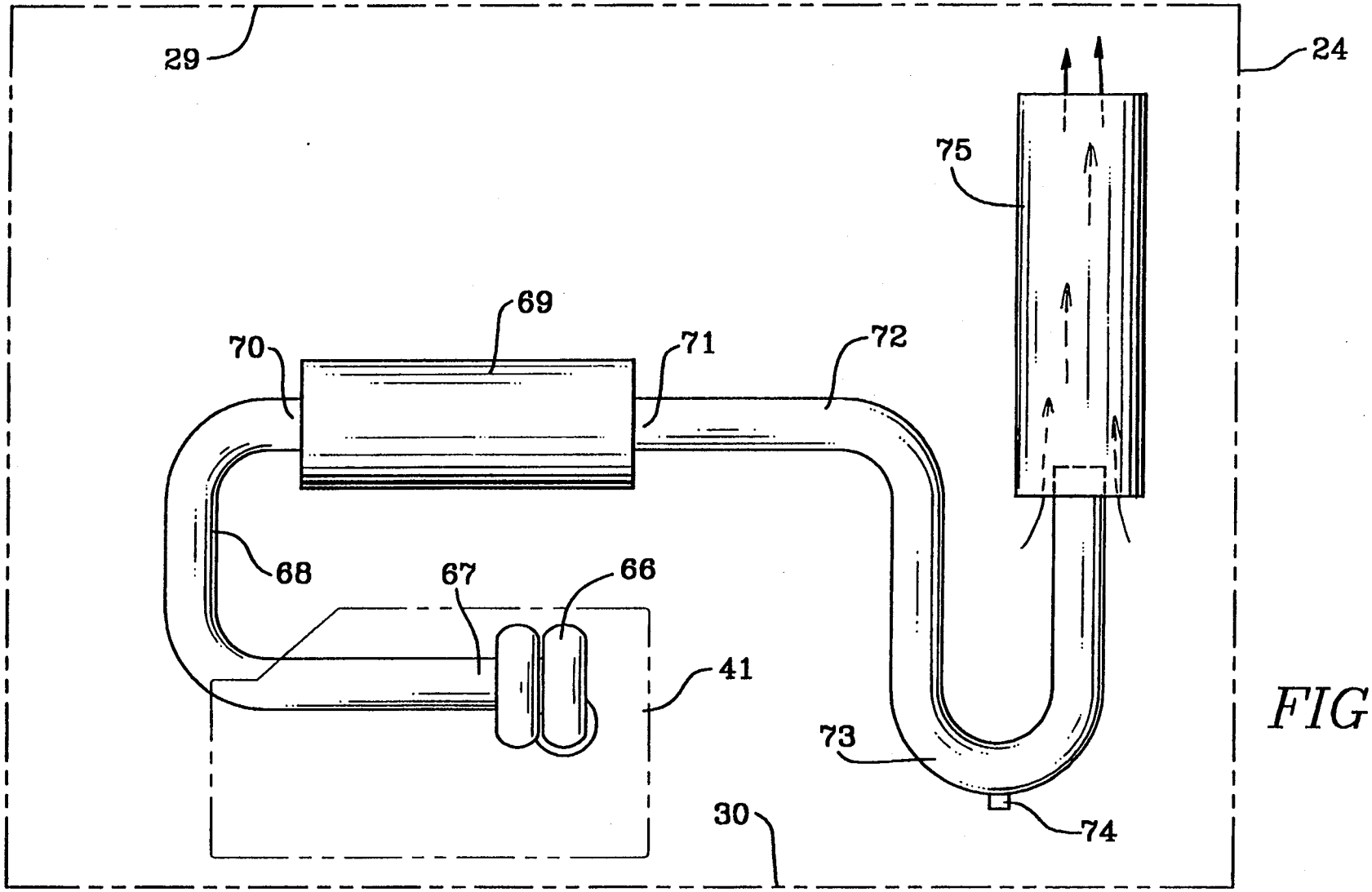
FIG. 7 is a partial, functional diagram illustrating an improved noise attenuating system according to the present invention.

FIG. 7 is a partial, functional diagram of the compressor 20 illustrating an improved noise attenuating system of the present invention. Referring to FIG. 7, mounted upon the diesel engine 41 is a turbocharger 66 having a turbocharger discharge 67. Exhaust fluid flows out of the diesel engine 41 through the turbocharger discharge 67. A conduit 68 is flow connected intermediate the turbocharger 66 and a muffler assembly 69, which includes an inlet 70 and a discharge 71. A conduit 72 is flow connected with the discharge 71 of the muffler assembly 69. The conduit 72 is specifically shaped, as illustrated in FIG. 7, to direct exhaust fluid in a direction down and away from the muffler assembly 69, and then, to direct exhaust fluid up toward the top portion 29 of the housing 24, thereby forming a conduit low point 73. The conduit low point 73 is operable to protect the compressor 20 from damage caused by rain, thereby eliminating the need for a conventional rain cap (not shown). A drain 74 is disposed at the conduit low point 73 to drain any water which collects at the low point. The conduit 72 extends into and terminates within a duct or pipe 75. The duct is sized sufficiently larger than the conduit 72 such that an airstream is able to flow between the conduit 72 and the pipe 75.

It has been discovered that the noise attenuating system illustrated by FIG. 7 reduces noise produced by the compressor by approximately 1 db, as compared with known exhaust systems. During operation of the compressor 20, hot gases flow from the conduit 72 and into the pipe 75. The sudden expansion of the exhaust fluid upon entering the interior volume of the larger pipe causes a break up in sound waves. Additionally, a venturi effect is created at the point where the conduit 72 enters the pipe 75. This venturi effect causes a mixing between the hot exhaust gases flowing from the conduit 72 and the cooler gases coming from outside the pipe 75. This mixing further attenuates the noise produced by the compressor 20. The pipe is terminated within the housing 24, approximately 4" from the top portion 29. A further sound reduction is achieved as the exhaust flow further expands from the confines of the pipe and into the interior volume of the rear the housing 24.

Compressor Bootstrap Loading System

Figure 5:
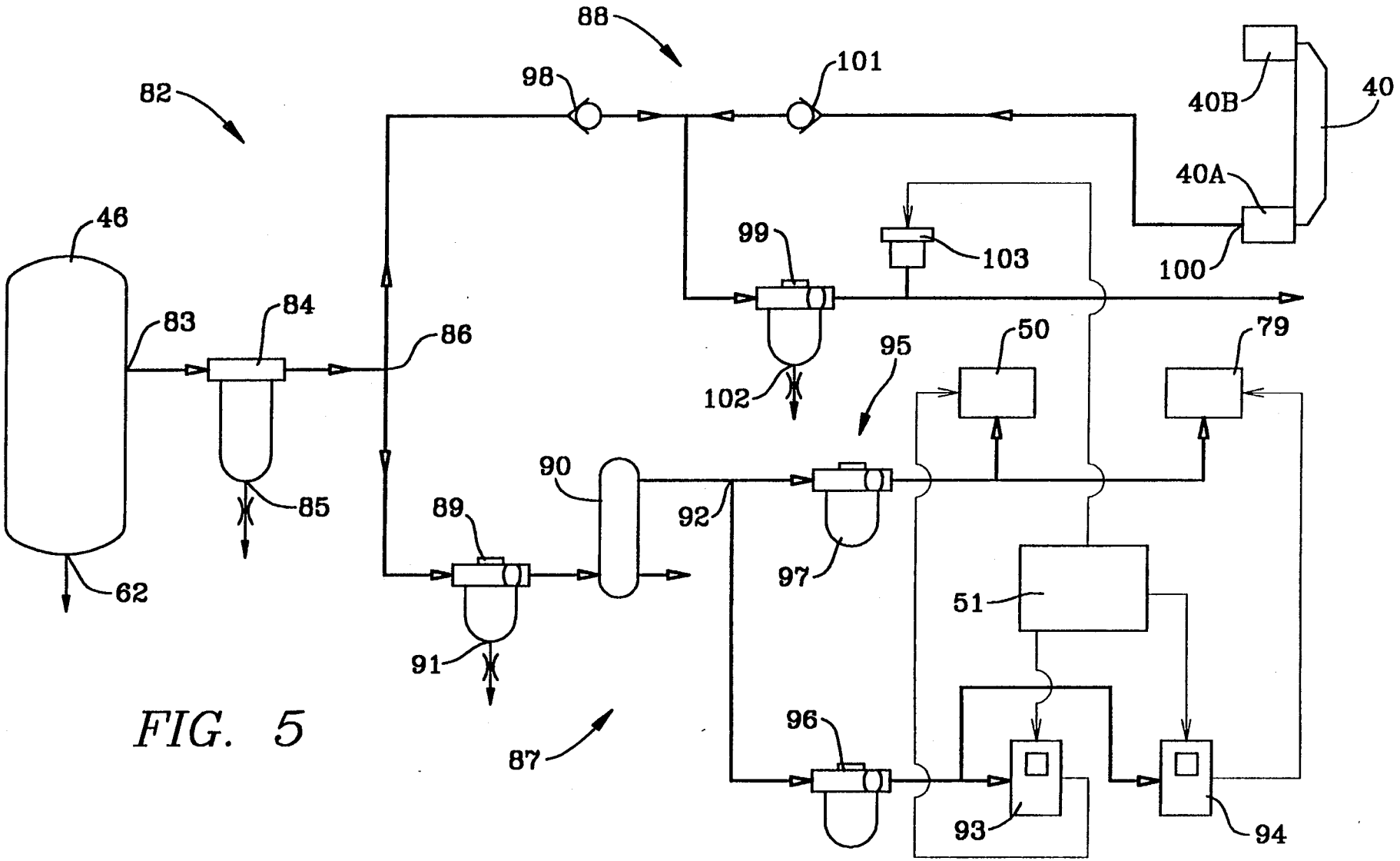
FIG. 5 is a functional schematic of a self-contained instrument air and seal air system according to the present invention.

Referring to FIGS. 4 and 5, an additional compressed air flow path is branched off the afterstage air line between the aftercooler 44 and receiver tank 46. This compressed air flow path provides internal air blowoff when the service valve 63 is closed, and also permits initial pressure loading via an initial bootstrap method as will be explained hereinafter.

A pneumatically operated butterfly type blowoff valve 77 and an electrically driven butterfly type loader valve 78 are flow connected intermediate the receiver tank 46 and the aftercooler discharge 60, in a location upstream of the check valve 61. The blowoff valve 77 and the loader valve 78 are connected in series, one to each other. The blowoff valve 77 is a spring loaded wide open type blowoff valve which is actuated by a single actuating pneumatic positioner/actuator 79. The pneumatic positioner/actuator 79 receives two sources of air, a signal air pressure ranging between 3–15 PSI and a source of motive air at 80 PSI. The positioner puts motive air of a varying pressure to a predetermined side of the blowoff valve actuator piston as dictated by the value of the 3–15 PSI signal. The blowoff valve 77 is modulated by pneumatic action as directed by the electronic controller 51.

The loader valve 78 is a butterball type valve which is driven by an electric driver, such as a 24 volt DC motor. The loader valve is normally positioned in an open position unless directed to close by the electronic controller 51. Flow connected intermediate the blowoff valve 77 and the loader valve 78 is a loader orifice/muffler combination 80 which includes an orifice having a critically sized inside diameter of approximately 1.0". Downstream of the loader valve 78 is a main discharge orifice/muffler combination 81.

As may be best understood by reference to FIG. 4, upon initial start-up of the compressor 20, the service valve 63 is disposed in a closed position and all air flow is through the blowoff valve 77. The loader valve 78 is open, and therefore, a predetermined volume of air flows through the loader orifice/muffler combination 80 and a predetermined volume of air flows through the main discharge orifice/muffler combination 81. At a predetermined time, the controller 51 causes the compressor to load and the engine to accelerate to a predetermined speed. Simultaneously, the controller 51 opens the inlet control valve 49 and closes the loader valve 78. With the loader valve 78 closed, all air must flow through the loader orifice/muffler combination 80, which includes the critically sized orifice having the 1.0" inside diameter. This 1.0" inside diameter is a suitable dimension to cause the system pressure to rise to a predetermined value of about 60 to 70 PSIG, at which time sufficient actuation pressure is available for control of the spring loaded blowoff valve 77. The controller 51 then closes in the blowoff valve in order to achieve a preselected discharge pressure. The loader valve 78 is reopened as the blowoff valve 77 is closing at a pressure of approximately 85 PSIG.

Self-Contained Instrument and Seal Air System

As best seen by reference to FIG. 5, the portable, diesel-driven centrifugal compressor 20 includes an instrument/seal air system which is generally indicated as 82. The instrument/seal air system 82 delivers clean, dry, regulated air to the inlet control valve positioner/actuator 50 and the blowoff valve positioner/actuator 79, and to airend seals at a predetermined regulated pressure. As used herein, the term seal air shall mean a source of low pressure, clean compressed air that is delivered to a high speed seal assembly (not shown) which is disposed on the main rotating shafts (not shown) of the airend 40 to provide a buffer air pressure between two sets of ring face seals (not shown) to prevent shaft lubricating oil from migrating into the compressed air stream.

The instrument/seal air system 82 is flow connected to, and is supplied with, compressed air from the receiver tank 46. Compressed air flowing from the receiver tank 46 exits the receiver tank at an outlet port location 83 which is disposed in a substantially higher location than the location of the compressed air entry into the receiver tank. The compressed air flowing from the receiver tank 46 is filtered by a primary air filter 84 which is mounted on the receiver tank 46. In the preferred embodiment, the primary air filter 84 includes a coalescing-type element which removes approximately 93% of all particulates, liquid or debris, greater than 1 micron in size. Any water which is removed at the primary air filter 84 is drained through a constant bleed orifice drain fitting 85 which is located at a bottom portion of the primary air filter 84. At a predetermined fluid point 86, the filtered compressed air flowing from the receiver tank 46 is separately directed to an instrument air branch 87 and a seal air branch 88.

As should be understood, compressed air which enters the instrument air branch 87 not only must be filtered, but also must be very dry, therefore, a secondary instrument air filter 89 is flow connected upstream of a dryer unit 90. In the preferred embodiment, the secondary instrument air filter 89 is a coalescing type filter, and the dryer unit 90 is a membrane type dryer. The secondary instrument air filter 89 removes substantially all of the solid and liquid particulates greater than 0.1 micron in diameter. Any droplets of liquid which are removed by the secondary instrument air filter 89 are discharged through an orifice drain fitting 91 which is located at a bottom portion of the secondary instrument air filter.

The dryer 90 removes water vapor, as opposed to water droplets, from the instrument air branch 87, and therefore, the dryer 90 must be close coupled in fluid flowing relation to the secondary instrument air filter 89 to prevent any water from condensing in the compressed airstream intermediate the secondary instrument air filter 89 and the dryer 90. At a predetermined fluid point 92, the filtered, dried compressed air is separately directed to first and second I/P transducers 93 and 94 (current-to-pressure converters), and to an actuator air branch 95. Air for the first and second I/P transducers 93,94 first flows through a filter/regulator unit 96 which reduces the pressure of the compressed air to 25 PSIG. The I/P transducers are disposed in signal receiving relation to the electronic controller 51 which is operable to supply the I/P transducer with a current signal ranging between 4 and 20 milliamps. The I/P transducers are disposed in pneumatic signal transmitting relation to the inlet control valve pneumatic positioner/actuator 50 and the blowoff valve pneumatic positioner/actuator 79 to provide these positioner/actuators with a 3–15 PSIG pneumatic signal which is linear with respect to the 4–20 milliamp current signal.

As best seen by reference to FIG. 5, compressed air for the actuator air branch 95 flows from the fluid point 92 through a pressure regulator 97 which reduces the pressure of the compressed air to 80 PSIG. The pressure regulator 97 may be fitted with a drain cock for occasional draining. The 80 PSIG compressed air is then supplied to the inlet control valve pneumatic positioner-/actuator 50 and the blowoff valve pneumatic positioner/actuator 79 to control operation of the inlet control valve 49 and the blowoff valve 77 in response to the 3–15 PSIG signal air supplied from the I/P transducers 93,94.

As illustrated by FIG. 5, there are two sources of compressed air for the seal air branch 88. When the compressor 20 is loaded, the primary source of seal air flows from the receiver tank 46, through a check valve 98, and through a seal air pressure regulator 99. The seal air pressure regulator 99 reduces the pressure of the compressed air to 7 PSIG. An orifice drain fitting 102 is installed at a bottom portion of the seal air pressure regulator 99 for discharging any collected water in the pressure regulator. When the compressor 20 is not loaded, a second source of seal air is provided from a tap port 100, which is disposed at a predetermined location on the compressor 40, such as on the head of the first stage 40A outlet, for example. This tap port 100 bleeds air from the first stage outlet at approximately 4–5 PSIG. The 4–5 PSIG stage 1 bleed air flows through a check valve 101 to the pressure regulator 99. Therefore, if the receiver tank pressure is equal to or greater than the pressure in the first stage tap line, the receiver tank 46 will supply the pressure to the seal air branch. However, if the receiver tank pressure is below the tap pressure from the first stage outlet, the first stage outlet will supply the seal air pressure. The low pressure seal air is then supplied to the seal air manifold (not shown) which is mounted on the airend 40.

A normally open pressure switch 103, which is disposed in electronic communication with the electronic controller 51, is mounted in pressure sensing relation with the seal air pressure regulator 99. The pressure switch 103 provides automatic shutdown of the compressor 20 in such instances when the pressure of the compressed air flowing from the pressure regulator 99 is below a predetermined magnitude, which in the preferred embodiment is 2.5 PSIG.

Self-Contained Lubricating Oil System

Figure 6:
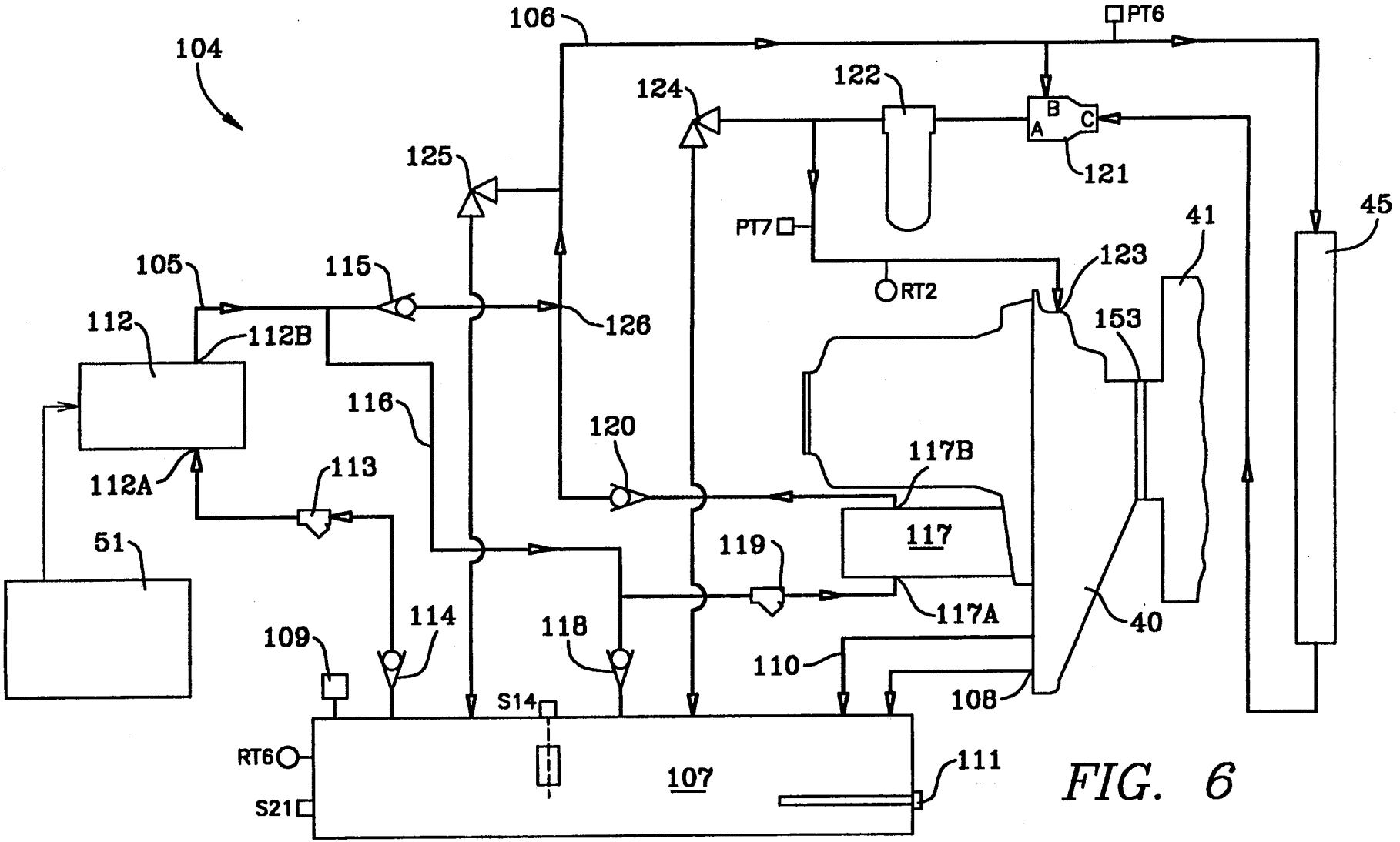
FIG. 6 is a functional schematic of a self-contained lubricating oil system according to the present invention.

FIG. 6 shows generally at 104 a self-contained, constant lubricating oil replenishment system according to the present invention. As illustrated by FIG. 6, the lubricating oil system 104 includes a pre-lubrication pump circuit 105 and a main lubrication pump circuit 106, both circuits being described in further detail hereinafter.

A chassis-mounted oil reservoir or sump tank 107 holds lubricant for the lubricating oil system 104. The sump tank is initially factory charged with 30 gallons of a suitable lubricant, such as MIL-L-23699C, for example. After initial startup of the compressor 20, approximately 5 gallons of oil are retained in the lubricating oil system 104, leaving a normal oil volume of 25 gallons in the sump tank. The sump tank 107 is flow connected to an airend bottom oil drain 108 which is disposed at an airend gearcase location. Lubricant leaving the airend 40 through the drain 108 flows by gravity to the sump tank 107. Instrumentation is mounted in sensing relation on the sump tank 107, such as a sump tank lubricant temperature sensor RT6, a lubricant level switch S14, and a high temperature shutdown switch S21. Lubricant level switch S14 provides for emergency shut down of the compressor 20 upon reaching a dangerous lubricant level. The compressor can be shutdown in the event of high temperatures at RT6. Switch S21 is an emergency high temperature switch which is set at the highest level the system can sustain, 220° F.

The sump tank 107 is vented through a porous-metal breather vent 109 which is mounted at a top portion of the sump tank. A vent line 110 flow connects the airend gearcase with the sump tank 107. The vent line 110 permits the sump tank 107 and the airend gearcase to function at near ambient pressure to ensure that a back pressure is not created that would cause a disruption in the airend lubrication. A heating apparatus 111, such as a 1000 Watt, 115VAC heating unit, permits the lubricating oil system 104 to function in arctic conditions.

The prelubrication pump circuit 105 includes a 24VDC motor-driven, self--priming prelubrication pump 112 having an inlet 112A and a discharge 112B. The pump 112 provides initial lubrication to airend bearings prior to starting the engine 41. The electronic controller 51 directs operation of the prelubrication pump 112. The prelubrication pump 112 is flow connected with the sump tank 107 by way of a y-strainer 113 and a check valve 114. The Y-strainer provides coarse straining to prevent large particles from flowing to the prelubrication pump 112. The check valve 114 is operable to ensure that the line downstream of the prelubrication pump is always full of oil to ensure that the self-priming duty of the prelubrication pump is minimal. The prelubrication pump delivers oil into the main lubrication circuit 106 through a suitably-sized discharge check valve 115 which prevents any oil from bypassing the airend 40 when the prelubrication pump 112 is deactivated. A hose 116 flow connects the prelubrication pump discharge 112B to a main pump suction, which is discussed further hereinafter.

The main lubrication pump circuit 106 includes a self-priming main oil pump 117 which is airend-driven at gear shaft engine speed, and which includes an inlet 117A and a discharge 117B. The main oil pump provides the main oil pumping function once the engine is operating at predetermined run speeds. When operating, the main oil pump 117 draws oil from the sump tank 107 to the inlet 117A through a check valve 118 and a Y-strainer 119. Oil lubricant flows from the main oil pump 117, through a discharge check valve 120, to an oil temperature control valve 121. Hose 116 connects the prelubrication pump discharge 112B with the main oil pump suction 117A, thereby providing a prepriming function for the main oil pump 117.

The oil temperature control valve 121 is a "mixing-mode" valve which ensures that oil is delivered to the airend 40 at a temperature no less than 130° F. Lubricant temperature regulation is accomplished by causing a predetermined volume of oil to bypass the oil cooler 45 to thereby regulate the temperature of the oil flowing to the airend. Under high ambient conditions, the oil temperature control valve 121 causes nearly all the hot oil to flow through the oil cooler for cooling. Under low ambient conditions, only a portion of the hot oil is permitted to flow through the oil cooler 45. Lubricant flowing from the oil temperature control valve 121 flows to an oil filter 122 which filters the lubricant to 3 microns. Lubricating oil is then delivered to an airend oil supply port 123. Oil pressure within the main lubrication pump circuit 106 is regulated to 25 PSIG by an oil pressure regulating valve 124 which bypasses excess oil back to the sump tank 107 to maintain constant oil supply pressure to the airend supply port 123. The main lubrication pump circuit 106 also includes a 150 PSIG relief valve 125. Instrumentation in the main lubrication pump circuit includes an oil cooler inlet pressure sensor PT6, an airend oil supply pressure sensor PT7, and an airend oil supply temperature sensor RT2.

In operation, when a user directed signal is inputted to the electronic controller 51, the prelubrication pump 112 is actuated for approximately 10 seconds before the engine 41 is cranked. The prelubrication pump 112 operates continuously during cranking and while the engine is idling. At idle speeds of 1000 RPM, both the prelubrication pump 112 and the main oil pump 117 are operating delivering oil to a fluid point 126. Back flow or cross flow is prevented by the check valves 115 and 120. When the compressor is loaded and the engine is accelerated to a predetermined speed, the prelubrication pump 112 is deactivated because the main oil pump is able to carry the entire lubricating duty. Therefore, the prelubrication pump is utilized for prelubrication duty and for providing supplemental oil flow at engine idle speeds. When the engine 41 is stopped, a time-based backup circuit, which is external to the controller 51, causes the prelubrication pump 112 to instantly start and to run for a predetermined amount of time, about 10 seconds after the engine has reached 0 RPM.

Cooling System

FIGS. 4, 8 and 9 illustrate generally at 130, an air cooling system for an engine driven, multi-stage compressor, such as the portable, diesel driven centrifugal compressor 20, for example. The air cooling system 130 is operable to cool final stage compressed air to a temperature of about 55° F. above ambient temperatures, which thereby eliminates, in most instances, the need to incorporate an additional stand alone aftercooler to supplement the main air cooling system of the compressor. The compressor 20 includes four elements where heat is rejected, namely the intercooler 42, the aftercooler 44, the oil cooler 45, and the engine radiator 47. The cooling system 130 utilizes a design which critically positions the four coolers in predetermined locations within the compressor housing 24, and this critical cooler positioning permits the cooling system 130 to achieve final stage compressed air temperatures of about 55° F. above ambient temperatures.

As illustrated by FIGS. 4 and 9, the air cooling system 130 includes an engine-driven, 54" diameter fan 131 which provides a cooling airstream across the four coolers. The fan 131 may be either a constant speed or a variable speed fan. In the case of a constant speed fan, the fan 131 is generally belt-driven and rotates at a fixed percentage of engine speed, e.g., at 1800 RPM engine speed, the fan speed would be 990 RPM with a fan pulley ratio of 0.55. In the case of a variable-speed fan 131, the fan is driven either by a multiple-speed clutch drive or a variable-transmission driver. As illustrated by FIG. 4, cooling air is drawn by the fan 131 through the suitably sized ambient air intakes 38, and the cooling air then flows from front to rear through the interior of the housing 24 removing heat generated by the airend 40, the engine 41, and other elements of the compressor. Thereafter, cooling air flows across the fan, and is pushed by the fan through the four cooling cores. After the cooling airstream has flowed across the cooling cores, it is directed vertically upward out of the housing 24 through the cooling air exhaust area in the top portion 29 of the housing 24.

As best seen by reference to FIGS. 4 and 9, the intercooler 42, the aftercooler 44, the oil cooler 45, and the engine radiator 47 are critically arranged in two series of banks, each bank comprising two cooling cores juxtaposed one to each other. In this regard, the intercooler 42 and the engine radiator 47 comprise the first bank which is positioned substantially adjacent to the fan 131 to receive the coolest cooling airstream. The aftercooler 44 and the oil cooler 45 comprise the second bank which receives warmer cooling air which has first passed through first bank.

Cooling priority is given to the intercooler 42 and the radiator 47. In this regard, an operating limitation which would require that the compressor 20 be shut down is the temperature of the engine coolant, therefore, the engine radiator 47 must receive the coolest air possible. Additionally, and with respect to the compressed air system, the intercooler 42 has a higher cooling priority than the aftercooler 44. The intercooler prepares the air for entry into the second compressor stage 40B. To ensure efficient compressor operation, air entering the second stage 40B should be as close to ambient temperature as possible. The intercooler 42 cools the interstage air to within 25° F. of ambient temperature.

As illustrated by FIG. 8, the intercooler receives hot discharge air from stage 1 40A at the intercooler top header portion 52. The hot compressed air flows downward through the intercooler core toward the intercooler discharge 55. Accordingly, the hottest air is located in the upper portion of the intercooler 42. In this regard, testing has demonstrated that the cooling air stream which has already flowed through the top portion of the intercooler 42 is actually hotter than the oil flowing into the oil cooler 45. Therefore, the total height of the oil cooler 45 must not exceed about 60% of the total height of the intercooler. In the preferred embodiment, the oil cooler 45 should not approach within 20" of the top of the intercooler.

Because of the placement of the oil cooler 45 with respect to the intercooler 42, a pressure balancing plate 132 is placed in the height void above the oil cooler 45 to prevent cooling air from flowing away from the oil cooler 45. In this regard, during operation of compressor 20, without the pressure balancing plate 132, as the cooling air passes through the top of the intercooler 42, the air seeks a low pressure path through the interior rear portion of the housing to the top of the package and out the cooling air exhaust, instead of flowing through the oil cooler 45. The pressure balancing plate 132 is suitably designed to exactly match the pressure drop across the oil cooler 45 at a predetermined airflow and velocity of the cooling airstream of the cooling system 130. Therefore, the pressure balancing plate 132 ensures that an adequate supply of cooling air flows across the oil cooler 45. In the preferred embodiment, the pressure balancing plate 132 consists of 1" square apertures. As best seen by reference to FIG. 9, the oil cooler 45 is pivotally mounted on a hinge assembly 137 to per,nit the oil cooler to swing-out for future maintenance.

The radiator 47 includes a top header portion 133 into which hot coolant from the engine 41 flows, and a bottom portion 134 from which cooled coolant flows back to the engine. Flow connected intermediate the top header portion 133 and the bottom portion 134 is a radiator bypass hose 135.

The height of the aftercooler 44 is restricted by the location of the top header portion 133 of the radiator 47, the aftercooler being positioned under the top header portion. The width of the aftercooler is limited to permit access to the radiator bypass hose 135. A pressure balancing plate 136, which functions in the same manner as the pressure balancing plate 132, is placed in the width void adjacent to the aftercooler 44, in front of the radiator bypass hose 135, to prevent cooling air from flowing away from the aftercooler. The pressure balancing plate 136 is suitably designed to exactly match the pressure drop across the aftercooler 44 at the desired airflow and velocity of the cooling airstream of the cooling system 130. In the preferred embodiment, the pressure balancing plate 136 contains 1" square apertures. As best seen by reference to FIG. 9, the aftercooler 44 is pivotally mounted on a hinge assembly 138 to permit the aftercooler to swing-out for future maintenance.

The total of all the heat rejection occurring in these four cooling cores of the cooling system 130 is significant. Yet, the design of the air cooling system 130 permits the compressor 20 to produce final stage compressed air at temperatures approximately 55° F. above ambient temperature, ensures that the temperatures and objectives of each cooler core are met, conserves space to permit the air cooling system components to be mounted in as small packages as possible, and permits access to the cooling cores for future maintenance.

Electronic Control System

Figure 11:
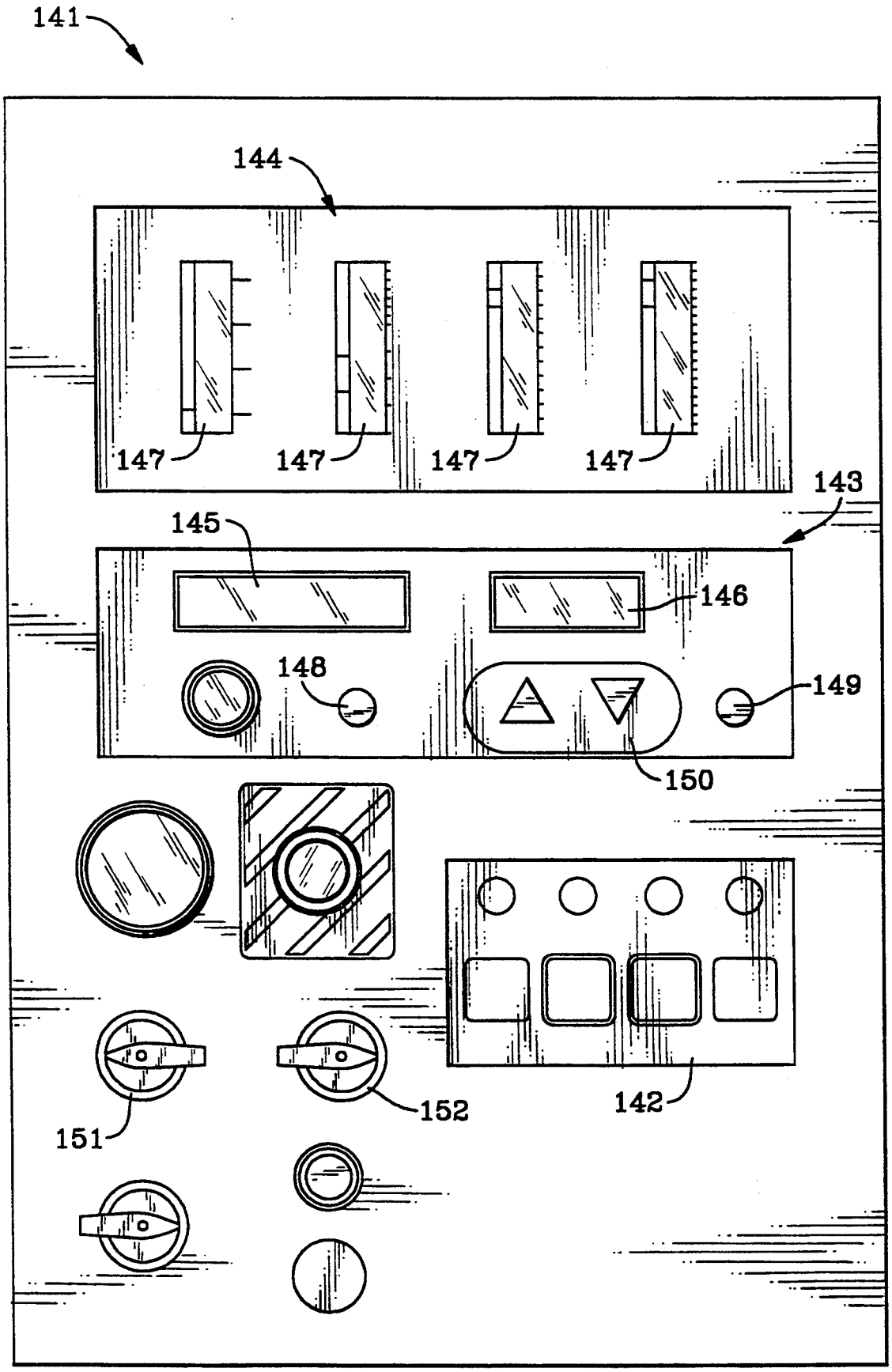
FIG. 11 is an illustration of a control panel face for the electronic control system of FIG. 10.
Figure 12:
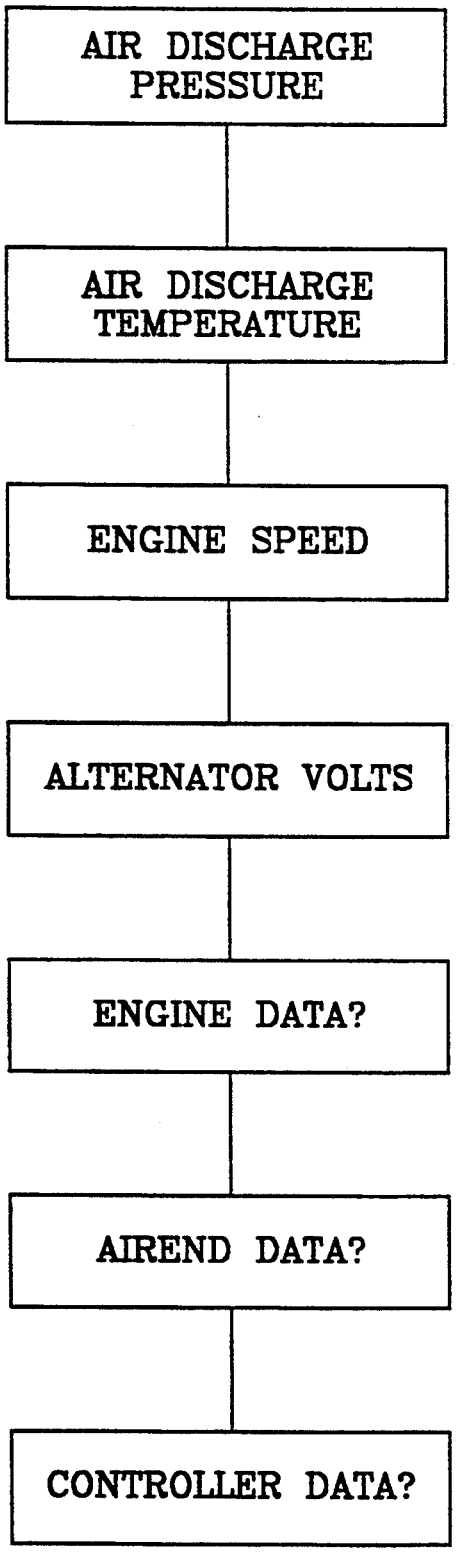
FIG. 12 is a block diagram of a top level menu structure used by the electronic control system.
Figure 13:
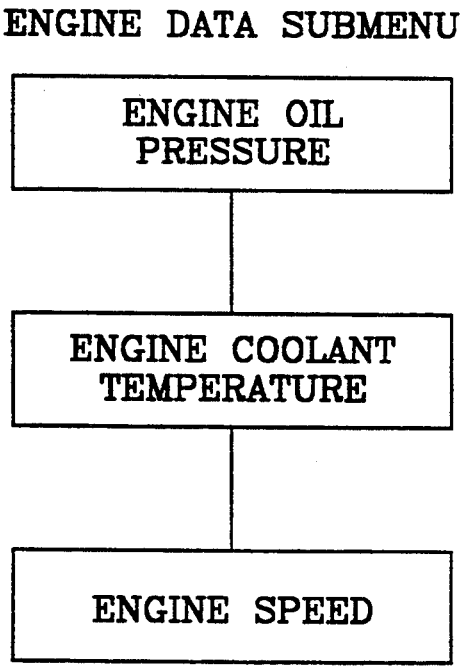
FIG. 13 is a block diagram of an engine data submenu structure used by the electronic control subsystem.
Figure 14:
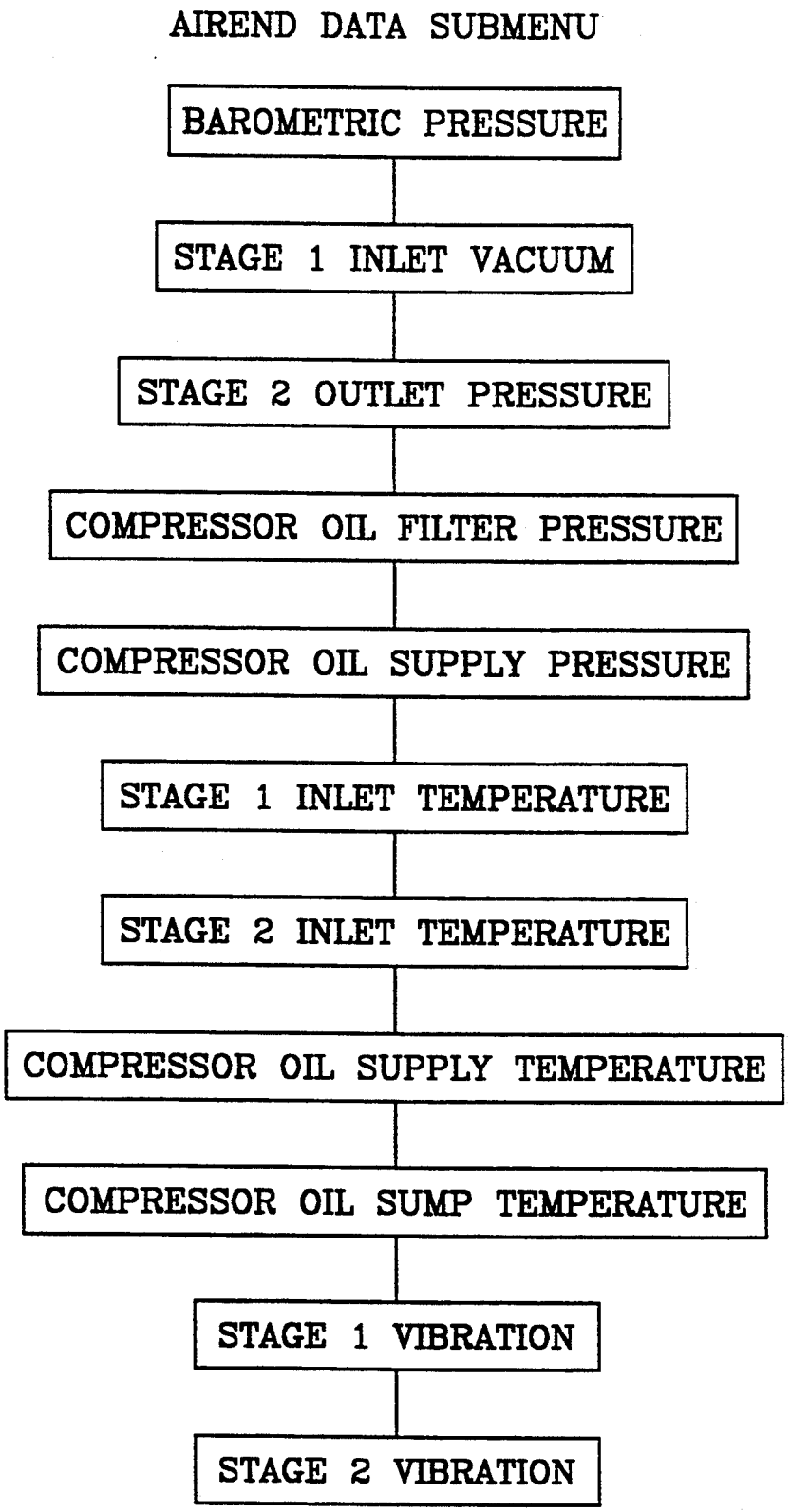
FIG. 14 is a block diagram of an airend data submenu structure used by the electronic control subsystem.
Figure 15:
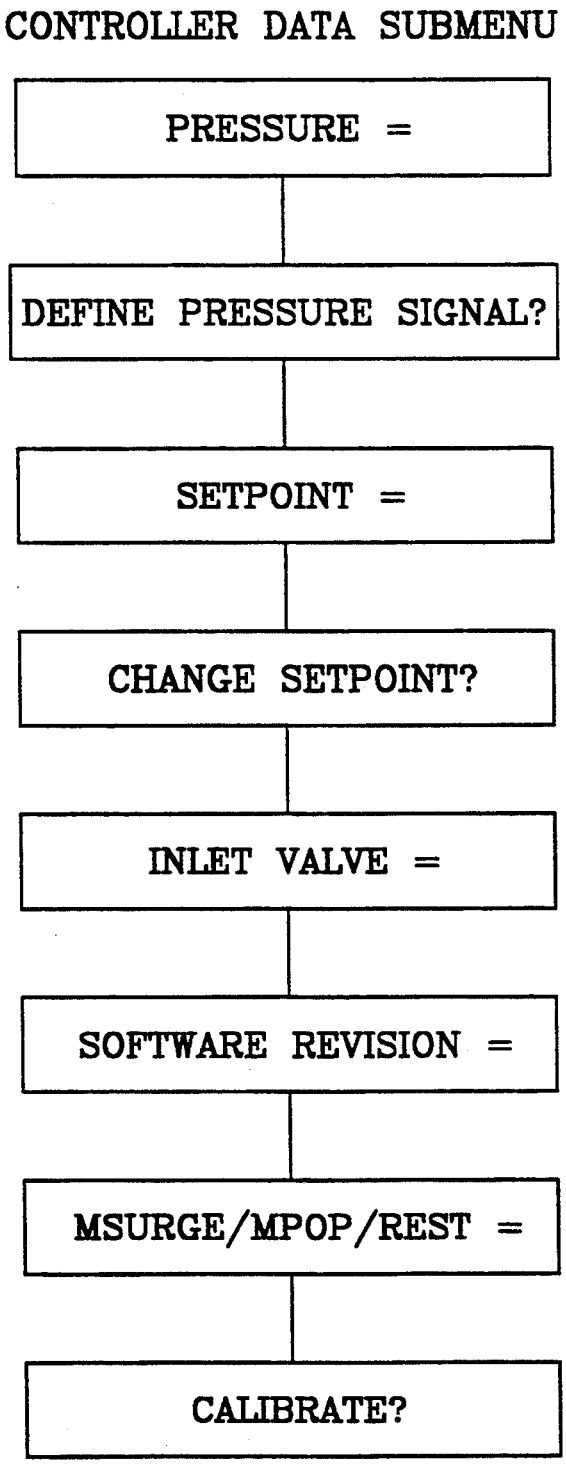
FIG. 15 is a block diagram of a controller data submenu structure used by the electronic control subsystem.

FIG. 10 provides a functional block diagram of a compressor electrical control system 140 which includes the microprocessor-based electronic controller 51 which provides complete control of the compressor 20. FIG. 11 illustrates an electronic operator control panel 141 which is described in detail hereinafter.

As previously described and referring to FIGS. 4, 6, and 10, eight pressure sensors are used to provide the electronic controller 51 with pressure measurements at predetermined fluid locations in the compressor 20, namely, PT1 (barometric pressure), PT3 (stage 1 inlet vacuum), PT4 (stage 2 outlet pressure), PT5 (receiver tank pressure), PT6 (oil cooler inlet pressure), PT7 (airend oil supply pressure), PT8 (external system pressure), and PT10 engine oil pressure). With the exception of the engine oil pressure sensor PT10, which is a resistance sender type sensor, all other pressure sensors are 50 millivolt pressure transducers.

As previously described and referring to FIGS. 4, 6, and 10, six temperature sensors are used to provide the electronic controller 51 with temperature measurements at predetermined fluid locations in the compressor 20, namely, RT1 (stage 1 inlet temperature), RT2 (airend oil supply temperature), RT3 (stage 2 inlet temperature), RT5 (receiver tank temperature), RT6 (airend oil sump temperature), and RT7 (engine coolant temperature). All temperature sensors are 100 ohm resistance temperature detectors.

Referring to FIGS. 4 and 10, two identical speed sensors, G1 and G2, are used to provide the electronic controller 51 with speed inputs. The speed sensors are of the variable reluctance magnetic type and generate an alternating voltage signal with a frequency proportional to the rate at which gear teeth pass the pickup. The primary speed sensor, G1, measures compressor bull gear speed. The secondary speed sensor, G2, measures engine flywheel gear speed. Two proximity type vibration sensors, VP1 and VP2, are used to measure airend vibrations of the high-speed airend pinions (not shown). Each vibration sensor is connected to a respective vibration transmitter module (not shown) which converts the raw vibration signal to a 4–20 milliamp signal that is linear with vibration. The 4–20 milliamp signal from each vibration transmitter is connected to the electronic controller 51 for analysis.

Referring to FIGS. 10 and 11, the electronic control system 140 includes an electronic control module 142, an alphanumeric display module 143, and an electronic gauge module 144. The electronic control module 142 includes the electronic controller 51 and primary control switches and indicator lamps, namely a start switch, a load switch, an unload switch, a stop switch, a start mode lamp, a ready lamp, a loaded lamp, and a stop lamp, as best seen by reference to FIG. 11.

The alphanumeric display module 143 includes a message display 145, a digital display 146, an alert/shutdown lamp, and various switches for communicating with the electronic controller 51. The message display 145 is a two line by sixteen character display which provides a user with diagnostic information, operational status messages, and the name of a measured parameter being displayed in the digital display 146. The digital display 146 provides a numeral which corresponds to a displayed operational status message. The message display 145 provides machine operational status messages to a user, enables a user to monitor compressor operating parameters, displays diagnostic messages indicating when service is needed to an element of the compressor 20, displays causes of automatic shutdowns, permits a user to program certain operational features, and permits a user to perform certain service and troubleshooting techniques. Operation of the message display 145 is based on a top-level menu structure having three submenus, see FIGS. 12–15. The menu structure is accessed by way of a select switch 148, a return switch 149, and scroll switches 150. The select switch 148 permits a user to choose a feature or to answer "yes" to a question shown on the message display 145. The return switch 149 permits a user to return to a last position in the top level menu after being in one of the various submenus. The scroll switches 150 permit a user to either scroll to a next parameter in either a top-level or a sub-level menu, or to scroll to a previous parameter in either a top-level or sub-level menu.

The electronic gauge module 144 includes a plurality of lighted liquid crystal display (LCD) bar graph units which may display such information as the amount of fuel in tanks, oil pressure, engine coolant temperature, and service air temperature.

A regulation mode switch 151 permits operation of the compressor 20 in any of one of three compressor modes, namely a constant mode, an automatic load/unload mode, and an autostart/stop mode. The constant mode permits manual operation of the compressor 20.

The automatic load/unload mode improves compressor fuel economy during periods of low flow demand in compressed air applications by allowing the compressor 20 to automatically unload when not needed and to automatically reload when needed. While operating in the autostart/stop mode, the electronic controller 51 will shut down the compressor 20 if the compressor remains at a predetermined idle speed for 45 minutes. While the compressor 20 is shut down, the controller 51 continues to monitor receiver tank pressure. If the receiver tank pressure drops 10 PSI below a predetermined setpoint pressure, the electronic controller 51 automatically re-starts and re-warms up the compressor 20, if necessary, and the compressor 20 will go back on line. The regulation mode switch 151 in combination with a pressure setpoint switch 152 permit the compressor 20 to operate in a sequenced air compressor control strategy. For example, if five compressors were at a site, two machines may be set in the constant mode, two machines may be set in the load/unload mode at a predetermined pressure set slightly below a predetermined setpoint pressure of the machines operating in the constant mode, and the fifth machine may be an emergency backup compressor, set in the autostart/stop mode at a predetermined pressure lower than the machines operating in the load/unload mode.

The electronic controller 51 provides a full complement of diagnostics and automatic shutdowns to protect the compressor 20 from damage when in need of maintenance or in the event of malfunction. When the electronic controller 51 detects a compressor operating parameter above normal operating limits, an alert message will be displayed on the message display 145 and the alert/shutdown lamp will flash. When the electronic controller detects an operating parameter at a dangerously high or low level or if a critical sensor is malfunctioning, the machine will be automatically unloaded and stopped with the cause of the shutdown shown on message display. The alert/shutdown lamp will be illuminated steady when a shutdown condition exists.

While this invention has been illustrated and described in accordance with a preferred embodiment, it is recognized that variations and changes may be made therein without departing from the invention as set forth in the following claims.

Having described the invention, what is claimed is:

1. A portable compressed air system comprising:

a housing;

a diesel engine having a predetermined torsional inertia, a predetermined cranking speed, and a predetermined idle speed;

a centrifugal compressor flexibly coupled in motive force receiving relation to the diesel engine, the flexible coupling having a predetermined spring rate to place the torsional inertia of the compressor above a highest predetermined cranking speed and below the predetermined idle speed of the diesel engine;

a microprocessor-based electronic controller for controlling compressor operation;

a receiver for storing compressed air; and a means for cooling the portable compressed air system, the cooling means having a fan, an intercooler, an oil cooler, an engine radiator, and an aftercooler, and wherein the intercooler, the oil cooler, the radiator, and the aftercooler are arranged in two banks, each bank comprising two cooling cores juxtaposed one to each other.

2. A portable compressed air system, as claimed in claim 1, and wherein the intercooler and the engine radiator define a first bank which is positioned substantially adjacent to the fan, and the oil cooler and the aftercooler define the second bank.

3. A portable compressed air system, as claimed in claim 2, and wherein the oil cooler is positioned in front of the intercooler and the aftercooler is positioned in front of the radiator.

4. A portable compressed air system, as claimed in claim 1, further comprising:

a first, pneumatically driven, spring loaded open valve flow connected with a compressed air discharge of the aftercooler;

a second, electrically driven valve flow connected in series with the first valve, and disposed in signal receiving relation to the microprocessor-based electronic controller; and an orifice means, flow connected intermediate the first and second valves, for restricting the flow of a compressible fluid to produce a predetermined pressure signal of sufficient magnitude to close the spring loaded open first valve, at a predetermined time, to thereby load the compressor.

5. A portable compressed air system, as claimed in claim 4, and wherein the receiver supplies compressed air for use by the compressed air system, the portable compressed air system further comprising:

a controllable inlet valve flow connected with a centrifugal compressor inlet port;

means for filtering compressed air flowing from the receiver to the compressed air system;

means for separating the compressed air flowing from the receiver into a first path which provides a first source of seal air to at least one seal of a rotating shaft of the compressor, and a second path which provides instrument air to the compressed air system;

means for filtering and drying the compressed air entering the instrument air path;

means for separating the compressed air flowing in the instrument air path into a first path which provides actuating air to the controllable inlet valve and the first, pneumatically driven, spring loaded open valve, and a second path which provides a source of signal air;

pressure regulator means for regulating the air pressure in the actuator air path;

pressure regulator means for regulating the air pressure in the signal air path;

first and second current-to-pressure converters flow connected in the signal air path and disposed in electronic signal receiving relation to the microprocessor-based electronic controller, and wherein the first current-to-pressure converter is disposed in pneumatic signal transmitting relation to the controllable inlet valve and the second current-to-pressure converter is disposed in pneumatic signal transmitting relation to the first, pneumatically driven, spring loaded open valve; and pressure regulator means for regulating the air pressure in the seal air path, and wherein a second source of seal air is provided from a tap port disposed at a predetermined location on the centrifugal compressor.

6. A portable compressed air system, as claimed in claim 1, further comprising:

a first electric-driven pump flow connected in fluid receiving relation with a lubricant reservoir for providing a supply of lubricant to the centrifugal compressor prior to starting the diesel engine and for a predetermined period of time after the diesel engine is operating, and wherein the microprocessor-based electronic controller directs operation of the first pump;

a second compressor-driven pump for providing a primary lubricant pumping function during engine operation at predetermined run speeds, the second pump means flow connected in fluid receiving relation with the lubricant reservoir; and valve means, flow connected intermediate a discharge of the first pump and a discharge of the second pump, for preventing lubricant cross flow between the first and second pumps during simultaneous operation thereof.

7. A portable compressed air system, as claimed in claim 1, further comprising:

a turbocharger mounted on the diesel engine;

a muffler assembly having an inlet and a discharge;

a first conduit flow connected intermediate the turbocharger and the muffler assembly inlet;

a second conduit, having a predetermined outer diametral dimension, flow connected with the muffler assembly discharge, the second conduit shaped to direct an exhaust fluid in a direction down and away from the muffler assembly, and then, to direct the exhaust fluid up toward an interior, top portion of the housing, thereby forming a conduit low point;

a pipe having an inner diametral dimension sufficiently greater than the outer diametral dimension of the second conduit, the pipe receiving a predetermined portion of the second conduit such that an airstream is able to flow between the second conduit and the pipe, and wherein during operation, the exhaust fluid, which includes hot gases and sound waves, flows from the second conduit into the pipe wherein the sudden expansion of the exhaust fluid upon entering the interior volume of the larger pipe causes a break up in the sound waves, thereby attenuating diesel engine noise.

8. A portable compressed air system, as claimed in claim 7, and wherein the pipe extends to a predetermined distance from the interior, top portion of the housing which thereby permits a further sound reduction as the exhaust flow further expands from the interior of the pipe to the interior of the housing.

9. A portable compressed air system comprising:

a housing;

a diesel engine having a predetermined torsional inertia, a predetermined cranking speed, and a predetermined idle speed;

a centrifugal compressor flexibly coupled in motive force receiving relation to the diesel engine, the flexible coupling having a predetermined spring rate to place the torsional inertia of the compressor above a highest predetermined cranking speed and below the predetermined idle speed of the diesel engine;

a microprocessor-based electronic controller for controlling compressor operation;

a receiver for storing compressed air and for supplying compressed air for use by an object of interest and by the compressed air system;

a means for cooling the portable compressed air system, the cooling means having a fan, an intercooler, an oil cooler, an engine radiator, and an aftercooler, and wherein the intercooler, the oil cooler, the radiator, and the aftercooler are arranged in two banks, each bank comprising two cooling cores juxtaposed one to each other;

a first, pneumatically driven, spring loaded open valve flow connected with a compressed air discharge of the aftercooler;

a second, electrically driven valve flow connected in series with the first valve, and disposed in signal receiving relation to the microprocessor-based electronic controller;

an orifice means, flow connected intermediate the first and second valves, for restricting the flow of a compressible fluid to produce a predetermined pressure signal of sufficient magnitude to close the spring loaded open first valve, at a predetermined time, to thereby load the compressor;

a controllable inlet valve flow connected with a centrifugal compressor inlet port;

means for filtering compressed air flowing from the receiver to the compressed air system;

means for separating the compressed air flowing from the receiver into a first path which provides a first source of seal air to at least one seal of a rotating shaft of the compressor, and a second path which provides instrument air to the compressed air system;

means for filtering and drying the compressed air entering the instrument air path;

means for separating the compressed air flowing in the instrument air path into a first path which provides actuating air to the controllable inlet valve and the first, pneumatically driven, spring loaded open valve, and a second path which provides a source of signal air;

pressure regulator means for regulating the air pressure in the actuator air path;

pressure regulator means for regulating the air pressure in the signal air path;

first and second current-to-pressure converters flow connected in the signal air path and disposed in electronic signal receiving relation to the microprocessor-based electronic controller, and wherein the first current-to-pressure converter is disposed in pneumatic signal transmitting relation to the controllable inlet valve and the second current-to-pressure converter is disposed in pneumatic signal transmitting relation to the first, pneumatically driven, spring loaded open valve;

pressure regulator means for regulating the air pressure in the seal air path, and wherein a second source of seal air is provided from a tap port disposed at a predetermined location on the centrifugal compressor;

a first electric-driven pump flow connected in fluid receiving relation with a lubricant reservoir for providing a supply of lubricant to the centrifugal compressor prior to starting the diesel engine and for a predetermined period of time after the diesel engine is operating, and wherein the microprocessor-based electronic controller directs operation of the first pump;

a second compressor-driven pump for providing a primary lubricant pumping function during engine operation at predetermined run speeds, the second pump means flow connected in fluid receiving relation with the lubricant reservoir;

valve means, flow connected intermediate a discharge of the first pump and a discharge of the second pump, for preventing lubricant cross flow between the first and second pumps during simultaneous operation thereof;

a turbocharger mounted on the diesel engine;

a muffler assembly having an inlet and a discharge;

a first conduit flow connected intermediate the turbocharger and the muffler assembly inlet;

a second conduit, having a predetermined outer diametral dimension, flow connected with the muffler assembly discharge, the second conduit shaped to direct an exhaust fluid in a direction down and away from the muffler assembly, and then, to direct the exhaust fluid up toward the an interior, top portion of the housing, thereby forming a conduit low point;

a pipe having an inner diametral dimension sufficiently greater than the outer diametral dimension of the second conduit, the pipe receiving a predetermined portion of the second conduit such that an airstream is able to flow between the second conduit and the pipe, and wherein during operation, the exhaust fluid, which includes hot gases and sound waves, flows from the second conduit into the pipe wherein the sudden expansion of the exhaust fluid upon entering the interior volume of the larger pipe causes a break up in the sound waves, thereby attenuating diesel engine noise.

* * * * *